US008100164B2

(12) United States Patent
Goodman et al.

(10) Patent No.: US 8,100,164 B2
(45) Date of Patent: Jan. 24, 2012

(54) MOVABLE PARTITION SYSTEMS INCLUDING INTUMESCENT MATERIAL AND METHODS OF CONTROLLING AND DIRECTING INTUMESCENT MATERIAL AROUND THE PERIMETER OF A MOVABLE PARTITION SYSTEM

(75) Inventors: E. Carl Goodman, Bountiful, UT (US); Craig Bell, South Jordan, UT (US)

(73) Assignee: Won-Door Corporation, Salt Lake City, UT (US)

( * ) Notice: Subject to any disclaimer, the term of this patent is extended or adjusted under 35 U.S.C. 154(b) by 111 days.

(21) Appl. No.: 12/542,508

(22) Filed: Aug. 17, 2009

(65) Prior Publication Data

US 2011/0036509 A1 Feb. 17, 2011

(51) Int. Cl.
*E05D 15/26* (2006.01)

(52) U.S. Cl. ..... 160/199; 160/84.08; 160/84.09; 160/84.11; 160/206

(58) Field of Classification Search ..... 160/7, 40, 160/199, 206, 84.08, 84.09, 84.11
See application file for complete search history.

(56) References Cited

U.S. PATENT DOCUMENTS 3,346,909 A * 10/1967 Blackburn ..... 16/94 D
4,194,521 A * 3/1980 Banta ..... 137/67
4,799,528 A * 1/1989 Benitez ..... 160/199
4,931,339 A * 6/1990 Malcolm-Brown ..... 428/71
5,411,072 A * 5/1995 Starck et al. ..... 160/84.11
5,481,834 A * 1/1996 Kowalczyk et al. ..... 52/64
5,542,460 A * 8/1996 McKeon ..... 160/7
5,782,690 A * 7/1998 Gustafson et al. ..... 454/369
6,155,324 A 12/2000 Elliott et al.
6,313,594 B1 11/2001 Janutta
6,615,894 B1 * 9/2003 McKeon ..... 160/1
6,662,848 B2 12/2003 Goodman et al.
6,668,499 B2 * 12/2003 Degelsegger ..... 52/204.62
7,059,092 B2 6/2006 Harkins et al.
7,275,352 B2 10/2007 Autovino et al.
7,487,591 B2 2/2009 Harkins et al.
2008/0169069 A1 * 7/2008 Coleman et al. ..... 160/199

(Continued)

OTHER PUBLICATIONS

Rita Kogoy, Cornell Iron Works, Inc., Jan. 22, 2008, "Cornell Introduces TranZform® Fire Accordion Folding Fire Doors." http://news.thomasnet.com/fullstory/Fire-Doors-comply-with-ADA-accessibility-standards-538531.*

(Continued)

*Primary Examiner* — Katherine Mitchell
*Assistant Examiner* — Johnnie A Shablack
(74) *Attorney, Agent, or Firm* — TraskBritt

(57) ABSTRACT

Movable partition systems include a movable partition and an intumescent material positioned to seal a gap at a periphery of the partition. In some embodiments, masses of intumescent material may be shaped and positioned to expand toward one another, contact one another, and form a seal therebetween at a periphery of the partition when the movable partition is exposed to fire. A fire barrier may be provided by extending a partition along a track assembly, and heating an intumescent material to cause the intumescent material to expand, char, and form a seal extending along at least a portion of a periphery of the movable partition. Upon installing a movable partition, at least one mass of intumescent material may be positioned to seal at least a section of a gap at a periphery of the movable partition when the at least one mass of intumescent material is exposed to fire.

20 Claims, 5 Drawing Sheets

U.S. PATENT DOCUMENTS

2009/0038764 A1* 2/2009 Pilz ..... 160/194

OTHER PUBLICATIONS

Cornell Iron Works, Inc. "Tranzform® Fire Accordion Folding Fire Doors."*

Cornell Iron Works, Inc. "Tranzform® Fire Accordion Folding Fire Doors." Aug. 28, 2007. Accessed from: http://www.cornelliron.com/accordionFire.html.*

ES Report No. ESR-2300 for Tranzform Accordion Folding Fire Doors, dated Sep. 1, 2008, 2 pages.

* cited by examiner

MOVABLE PARTITION SYSTEMS INCLUDING INTUMESCENT MATERIAL AND METHODS OF CONTROLLING AND DIRECTING INTUMESCENT MATERIAL AROUND THE PERIMETER OF A MOVABLE PARTITION SYSTEM

TECHNICAL FIELD

Embodiments of the present invention are directed to movable partitions used as fire barriers, and to methods of forming and using such movable partitions.

BACKGROUND

Movable partitions are utilized in numerous situations and environments for a variety of purposes. Such partitions may include, for example, a movable partition comprising foldable or collapsible doors configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security barrier, a fire barrier, or both a security and a fire barrier. In such a case, the partition barrier may be configured to close automatically upon the occurrence of a predetermined event such as the actuation of an associated alarm. For example, one or more accordion or similar folding-type partitions may be used as a security barrier, a fire barrier, or both a security and a fire barrier wherein each partition is formed with a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other specified reason, the partition may be extended along an overhead track, which is often located above the door in a header assembly, until the partition extends a desired distance across the room. The deployed partition may extend from a jamb, located in the wall storage pocket at the proximal end of the track, to a lead post, which extends toward the distal end of the track and provides a connection with a mating striker or receiver post.

Generally, a fire barrier system or assembly provides a barrier to fire, smoke, and heat. Thus, a fire barrier may retard or resist the deleterious effects of fire, smoke, and heat for a certain period of time. A number of standardized tests that test the effectiveness of fire barrier assemblies have been developed for use in the building industry. These are published, for example, in the International Building Code (IBC®), and by the National Fire Protection Association (NFPA®), Underwriters Laboratories, Inc. (UL®), and the American Society for Testing and Materials (ASTM®), among others. Various agencies test fire barriers using these standardized tests, and assign ratings to fire barriers that indicate their effectiveness at slowing the progress of a fire. Barrier testing agencies include Intertek Testing Services, Underwriters Laboratories, Inc., Chiltern International Fire, Ltd., and Warrington Fire Research, among others. Ratings of fire barrier assemblies are generally provided in minutes, and typically vary from 20 minutes to 180 minutes. Examples of fire barrier assembly standards and testing methods can be found in Underwriters Laboratories, Inc. UL® 10B.

In order to provide an effective fire barrier, the track, lead post, and jamb, along with the movable partition and surrounding walls, must provide some level of fire resistance. However, the track, lead post, and jamb may include some open spaces or gaps through which flames may penetrate, reducing the ability of the apparatus to act as an effective fire barrier. Some conventional hinged doors and interior windows have incorporated intumescent materials into their design in an attempt to seal off gaps in the event of a fire. When a fire breaks out and temperatures around the intumescent material escalate sufficiently, an intumescent material may foam, expand, char, and solidify to provide a strong, fire-resistant seal. However, intumescent material that is improperly installed, tampered with, or damaged may not behave as intended and fail to provide an effective seal. Further, intumescent material may expand in unexpected ways or directions, failing to seal off the intended gaps. Finally, uncontrolled intumescent material may ignite, effectively transforming into a conduit for the fire to pass through the intended barrier.

BRIEF SUMMARY

In some embodiments, the present invention includes movable partition systems. The movable partition systems comprise a movable partition and an intumescent material positioned to seal at least a portion of a gap at a periphery of the movable partition.

In additional embodiments, the present invention includes movable partition systems including a first mass of intumescent material and a second mass of intumescent material. The second mass of intumescent material is spatially separated from the first mass of intumescent material. The first and second masses of intumescent material are shaped and positioned to expand toward one another, contact one another, and form a seal therebetween extending along at least a portion of a periphery of the movable partition when the movable partition is exposed to fire.

In still further embodiments, the present invention includes methods of providing a fire barrier, comprising extending a movable partition along a track assembly. The methods of providing a fire barrier further include heating an intumescent material to cause the intumescent material to expand, char, and form a seal extending along at least a portion of a periphery of the movable partition.

In other embodiments, the present invention includes methods of installing a movable partition. At least one mass of intumescent material is positioned to seal at least a section of a gap at a periphery of a movable partition when the at least one mass of intumescent material is exposed to fire.

BRIEF DESCRIPTION OF THE SEVERAL VIEWS OF THE DRAWINGS

While the specification concludes with claims particularly pointing out and distinctly claiming that which is regarded as the present invention, the advantages of embodiments of the invention may be more readily ascertained from the description of embodiments of the invention when read in conjunction with the accompanying drawings, in which:

DETAILED DESCRIPTION

Some illustrations presented herein are not meant to be actual views of any particular movable partition system or component thereof, but are merely idealized representations employed to describe embodiments of the present invention. Additionally, elements common between figures may retain the same numerical designation.

Figure 1:
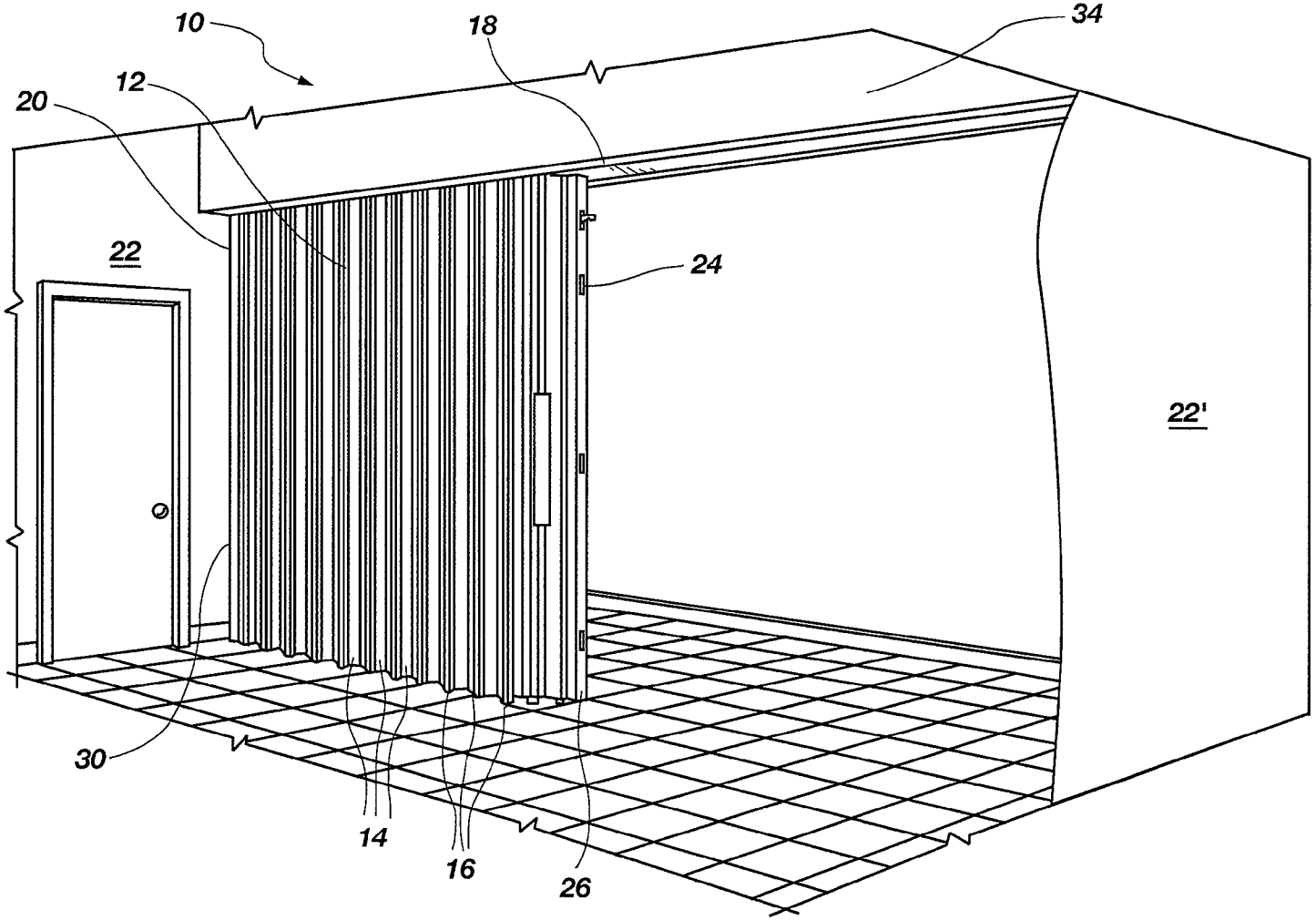
FIG. 1 is a perspective view of an embodiment of a movable partition system of the present invention.

Referring to FIG. 1, a movable partition system 10 is shown that includes a movable partition 12 in the form of an accordion-type door (sometimes referred to in the art as a "shutter"). The movable partition 12 may be used as a barrier, such as a physical barrier (a space partition), a security barrier, a fire barrier, a sound barrier, or a combination of the above. As used herein, the term "fire barrier" or "fire-resistant" means any material, structure, or element configured to provide a barrier to fire, smoke, and/or heat or configured to retard or resist the deleterious effects of fire, smoke, and/or heat for a certain period of time. In other embodiments, the movable partition 12 may be used, for example, to subdivide a relatively larger space into relatively smaller spaces (e.g., rooms or areas). The movable partition 12 may be formed with a plurality of panels 14 that are connected to one another with hinges or other hinge-like members 16 to form a pleated or plicated structure. The movable partition 12 is engaged with (e.g., suspended from) one or more tracks 18 along which the movable partition 12 moves as the movable partition 12 is extended to a closed position and retracted to an opened position. The hinged connection of the panels 14 allows the movable partition 12 to be compactly stored in a pocket 20 formed in a first wall 22 of a building when in a retracted or folded state.

Figure 5:
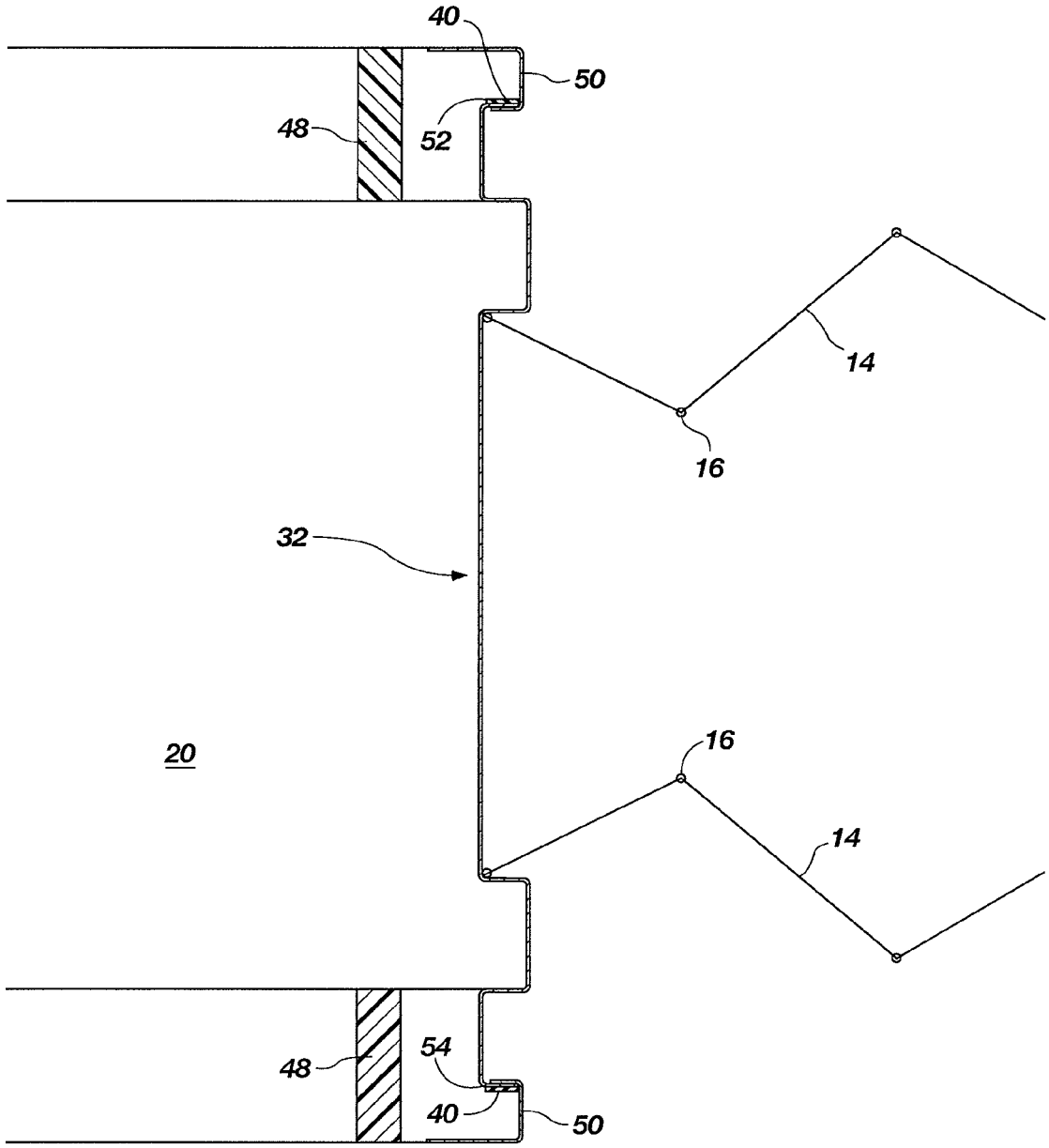
FIG. 5 is a simplified, partial cross-sectional view of a jamb of the movable partition system of FIG. 1.
Figure 6:
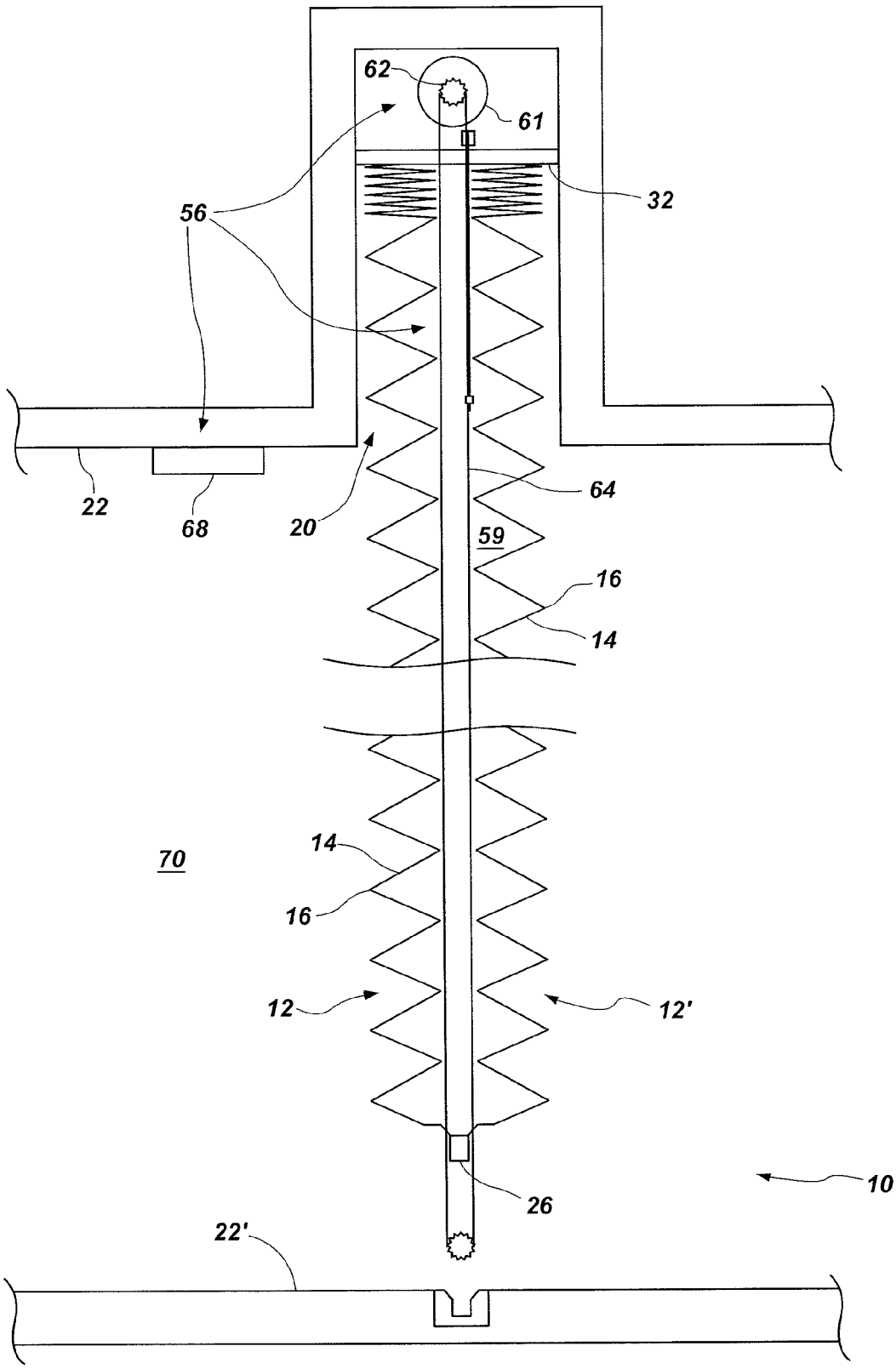
FIG. 6 is a simplified, schematic plan view illustrating an automatic drive system of the movable partition system of FIG. 1.

To deploy the movable partition 12 to an extended position, the movable partition 12 is moved along the tracks 18. Deployment may be achieved manually or automatically with an automatic closure system 56, as shown in FIG. 6, configured to extend the movable partition 12 upon the occurrence of a predetermined event, such as the actuation of an associated alarm. A distal end 24 of the movable partition 12 may include a lead post 26 comprising a leading end of the movable partition 12 and configured to engage with a mating striker or receiver post, which may be provided in a second wall 22' of a building to which the movable partition 12 may extend. A proximal end 30 of the movable partition 12 may include a floating jamb 32, as shown in FIG. 5, located within the storage pocket 20, which slides within the pocket 20 to accommodate the movable partition 12 when in a retracted state. The floating jamb 32 may be configured to engage a jamb stop to secure the floating jamb 32 in a fixed location when the movable partition 12 is in an extended state, such that the floating jamb 32 provides a more effective fire barrier. In other embodiments, the proximal end 30 of the movable partition 12 may include a fixed jamb located within the pocket 20. While the embodiment of the movable partition 12 shown and described with reference to FIG. 1 contains a single accordion-type door, additional embodiments of the present invention may include multiple doors. For example, a partition may include two doors (e.g., accordion-type doors) configured to extend across a space and join together to partition a space.

The movable partition system 10 also includes a track assembly 34. The movable partition 12 may be suspended from and supported by one or more tracks 18 of the track assembly 34. As shown, the track assembly 34 may be located within or adjacent a header protruding into the space where the movable partition 12 is located. In alternative embodiments, the track assembly 34 may be mounted to the ceiling or mounted to within an overhead structure, such as a recessed surface, such that the bottom surface of the track assembly 34 is flush with the ceiling. Furthermore, the movable partition 12 may be supported by the floor below the movable partition 12, and the track assembly 34 may simply serve as a guide for the movable partition 12. The movable partition 12 may include means to engage with the one or more tracks 18, such as slide mechanisms or pin and roller assemblies, so that the movable partition 12 is horizontally extendable along the length of the tracks 18.

Thus, the track assembly 34, the lead post 26, and the floating jamb 32 largely define what may be termed the border, periphery, or perimeter of the movable partition system 10. Each of the components defining the perimeter of the movable partition system 10 typically includes structures defining spaces or gaps that, when left without means to close the gaps, may be relatively weaker points in the fire barrier.

Figure 2:
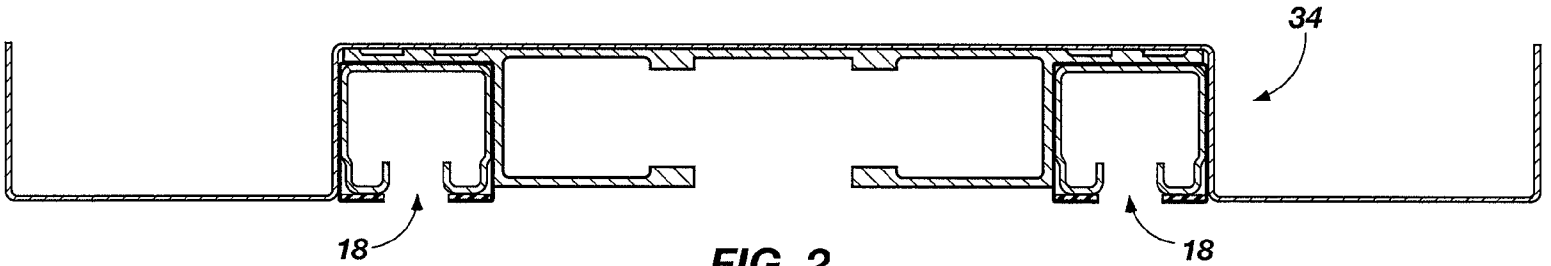
FIG. 2 is a partial cross-sectional view of a track assembly of the movable partition system shown in FIG. 1.

A partial cross-sectional view of the track assembly 34 of FIG. 1 that includes the tracks 18 is shown in FIG. 2. The track assembly 34 comprises an elongated structure spanning a space to be divided by the movable partition system 10 and defines a path along which a movable partition 12 may extend. The track assembly 34 may be generally straight, such as a structure spanning the width of a room or corridor having two opposing walls, or may include curves or bends to define a curved or serpentine path. The track assembly 34 shown includes two tracks 18, each configured to engage the movable partition 12. In alternative embodiments, the track assembly 34 may include only a single track 18 or additional tracks 18.

Figure 3:
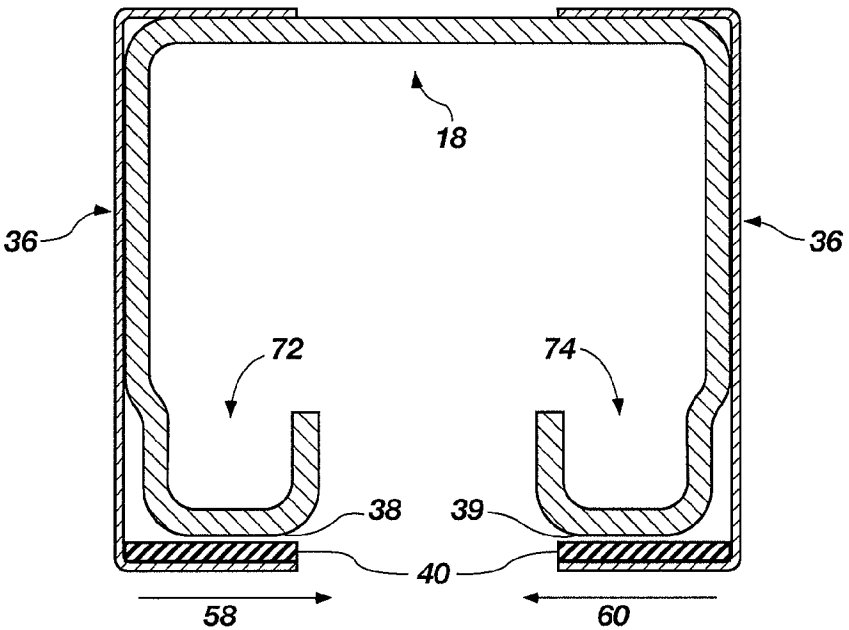
FIG. 3 is an enlarged view of a portion of FIG. 2 illustrating a track of the track assembly.

An enlarged, partial cross-sectional view of one track 18 of the track assembly 34 is shown in FIG. 3. The track 18 comprises an elongated member spanning the length of and following the path defined by the track assembly 34. The track 18 comprises an integral member confining an internal space on three sides, and having a first cup-shaped rail 72 and second cup-shaped rail 74 with a gap therebetween on a fourth side. Such a track may be formed, for example, from an elongated strip of sheet metal that is bent or folded to define three sides of a square or rectangle, and further bent or folded at the ends to form two cups configured to receive and support a slider or roller assembly of a movable partition 12. In alternative embodiments, the track 18 may be formed from two or more elongated members joined together and configured to engage with a movable partition such that the movable partition is horizontally extendable along the length of the track 18. Furthermore, the track 18 may have other cross-sectional shapes in other embodiments of the invention.

The track 18 may be at least partially surrounded by one or more shrouds 36, shown here as two generally "C"-shaped channels fitted tightly on the lateral sides of the track 18. In other embodiments, the shrouds 36 may comprise one integral piece or additional pieces, and may surround the track 18 more completely or less completely. The shrouds 36 may be of any material suitable for use in a fire barrier, such as steel. The shrouds 36 define spaces or gaps between bottom surfaces 38 and 39 of the first and second cup-shaped rails 72 and 74 of the track 18 and the shrouds 36.

In accordance with embodiments of the present invention, an intumescent material may be positioned to seal at least a portion of a gap at a periphery of the movable partition 12, as discussed in further detail below. As used herein, the term "intumescent material" means and includes any material that is formulated to swell (increase in volume) and scorch without significantly combusting, when exposed to heat, and is used for fire protection.

By way of example and not limitation, a strip of intumescent material 40 may be interposed between the bottom surfaces 38 and 39 of the cup-shaped rails 72 and 74 and the shroud 36 on each side of the opening leading to the interior space within the track 18. This technique at least substantially confines the strips of intumescent material 40 on three sides and allows expansion of the intumescent material 40 to occur in the direction parallel to the bottom surfaces 38 and 39 of the track 18, as indicated by arrows 58 and 60. When exposed to heat, each strip of intumescent material 40 may expand toward the strip of intumescent material 40 located under the opposing cup-shaped rail of the track 18. Each strip of intumescent material 40 may need to expand by a fraction of an inch to meet and form a seal across the entire bottom surface of the track 18. As part of this process, the seal forms around the pin and roller assemblies that roll in the track 18 under normal operation. Both the shroud 36 and the strips of intumescent material 40 may extend for the entire length of the track 18, or may only be located intermittently in portions thereof.

Figure 4:
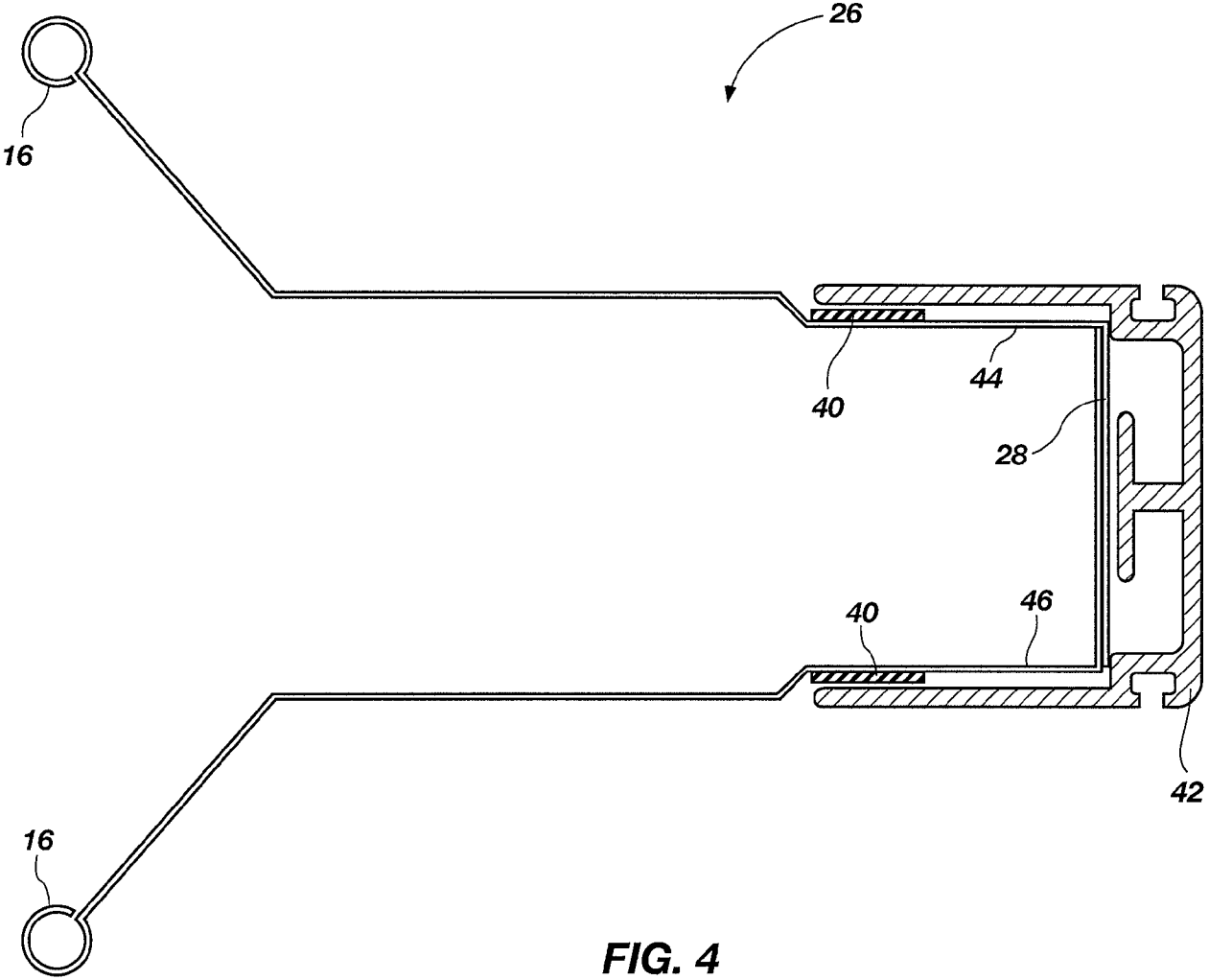
FIG. 4 is a partial cross-sectional view of a lead post of the movable partition system of FIG. 1.

A partial cross-section of the lead post 26 of FIG. 1 is shown in FIG. 4. The lead post 26 comprises a leading end 28, which is at least partially surrounded by a leading end cap 42. The cap 42 may be made of any material suitable for use in a fire barrier, such as steel. The cap 42 defines a space or gap between the lateral sides 44 and 46 of the lead post 26 and the cap 42. The cap 42 is also configured to provide a connection with a mating striker post, in the case of a single movable partition 12, or a mating receiver post, in the case of two movable partitions 12 meeting to divide a space, when the movable partition 12 is fully extended. A strip of intumescent material 40 may be sandwiched between the cap 42 and each of the sides 44 and 46 of the lead post 26. This technique at least substantially confines the strips of intumescent material 40 on three sides. Under fire conditions, the strips of intumescent material 40 expand out around the cap 42 and over to the surface of the mating striker or receiver post. As a result, a seal forms between the lead post 26, and the mating striker or receiver post to which it is connected. The strips of intumescent material 40 may extend from the floor to the track assembly 34 (i.e., the full height of the lead post 26), or may only be located intermittently at selected portions thereof.

A partial cross-section of a jamb 32 in accordance with an embodiment of the present invention is shown in FIG. 5. The jamb 32 shown is a floating jamb 32, but other embodiments may include a fixed jamb, as was previously noted. The floating jamb 32 rolls in the track 18 in the pocket area 20 of the movable partition system 10 (FIG. 1) and extends from one side of the pocket toward the other, spanning nearly from wall to wall. Polymeric sweeps 48 may extend from the side surfaces of the floating jamb 32 such that they make contact with the walls of pocket 20, thereby creating a smoke and draft seal. To prevent the floating jamb 32 from exiting the pocket 20, jamb stops 50, configured to provide an interlocking connection with the ends of the floating jamb 32, are installed toward the front end of the pocket 20. The floating jamb 32 and jamb stops 50 may be of any material suitable for providing a fire barrier, such as steel.

Strips of intumescent material 40 may be adhered to outside return surfaces 52 and 54 of the floating jamb 32, which are configured to meet the jamb stops 50. The strips of intumescent material 40 may extend for the entire length and height of the outside return surfaces 52 and 54, or may only be adhered to selected portions thereof. The outside return surfaces 52 and 54 may be formed by making a return bend on the floating jamb 32 itself, or by fastening an angled piece to the ends of the floating jamb 32. The outside return surfaces 52 and 54 may not be exposed to view under normal operation and are protected from friction between the jamb stop 50 and the floating jamb 32. Under fire conditions, the strips of intumescent material 40 expand inside the pocket 20 until they form a seal between the outside return surfaces 52 and 54 of the floating jamb 32 and the walls of pocket 20.

The strips of intumescent material 40 that may be located in the track 18, lead post 26, and floating jamb 32 may be of any intumescent material 40 known in the art to be suitable for fire barrier applications. For example, the intumescent material 40 may comprise a soft char or a hard expanding char producer, such as sodium silicate, graphite, or a sodium silicate- or graphite-based intumescent material 40, typically included as fibers in a polymer matrix. The intumescent material 40 may further include reinforcing mineral fibers. Further, the intumescent material may include at least one hydrate, which may have a cooling effect as water vapor is released when the material is exposed to fire. While the intumescent material 40 has heretofore been referred to as a flexible strip, it may be alternatively be applied or provided in the form of a resin, a spray, or a putty.

The strips of intumescent material 40 may be of any size or shape appropriate for the selected application and sufficiently small to fit within the gaps formed by the various structures as described above. For example, the strips of intumescent material 40 may have a rectangular cross-section of about ½ inch wide and about 1/16 inch thick. Intumescent materials suitable for use in a movable partition system 10 and commercially available may include FIREFREE®88, available from Firefree Coatings, Inc. of San Rafael, Calif., FLAME STOP V™, available from Flame Stop, Inc. of Fort Worth, Tex., FIRETEMP® Intumescent Strip, available from Fire Protection Systems of Denver, Colo., 3M™ EXPANTROL™ Flexible Intumescent Strip, available from 3M of St. Paul, Minn., TECNOFIRE® 2006, available from Lorient North America, Inc. of Lexington, Ky., and BLAZE SEAL, available from RectorSeal of Houston, Texas.

As shown in FIG. 6, the movable partition system 10 may include a first movable partition 12 and a second movable partition 12', each including a plurality of panels 14 coupled to one another with hinges or hinge-like members 16. The second movable partition 12' is laterally spaced from the first movable partition 12. Such a configuration may be utilized as a fire door wherein one movable partition (e.g., movable partition 12) acts as a primary fire and smoke barrier, a space 59 between the two movable partitions 12 and 12' acts as an insulator or a buffer zone, and another partition (e.g., movable partition 12') acts as a secondary fire and smoke barrier. Such a configuration may also be useful in providing an acoustical barrier when the partition is used to subdivide a larger space into multiple, smaller rooms. The first and second movable partitions 12 and 12' may be coupled to one another, for example, at the location of the lead post 26 and the floating jamb 32 such that they move in concert with one another and operate as a single movable partition 12.

Various means may be used to displace the movable partition 12 from a stowed condition to a deployed condition and vice versa. In one embodiment, an appropriate actuator may be used to displace the movable partition 12. For example, a drive may include a motor 61 coupled to a pulley or gear 62 configured to drive a transmission member such as a belt or chain 64.

A portion of the belt or chain 64 may be coupled to a trolley (not shown) that is configured to ride along the track 18. The trolley may be coupled to a component of the movable partition 12 such as, for example, the lead post 26. Thus, actuation of the motor 61 and belt or chain 64 in a first direction results in displacement of the trolley and lead post 26 so that the movable partition 12 may be deployed. Actuation of the motor 61 and belt or chain 64 in a second direction results in displacement of the trolley and lead post 26 so that the movable partition 12 may be retracted.

Additionally, various sensors, switches, and control electronics may be employed in association with such a drive to assist in the control of the movable partition system 10. These electronic components may be generally and collectively referred to as a movable partition controller 68. While shown as a box on the first wall 22, those of ordinary skill in the art will recognize that the sensors, switches and other electronic components may be distributed at various locations in and around the movable partition system 10. Control electronics may include, for example, a switch or actuator commonly referred to as "panic hardware," not shown here in detail. Actuation of the switch allows a person located on one side of the movable partition system 10 (e.g., in room 70) to cause the movable partition 12 to open if it is closed, or to stop while it is closing, so as to provide access through the barrier formed by the movable partition 12 for a predetermined amount of time.

It is noted that, while the above description has been more directed to an embodiment including a single movable partition 12 extending from the first wall 22 to the second wall 22', other movable partitions may be utilized. For example, a two-door, or bi-part partition configuration may be utilized wherein two similarly configured partitions extend across a space and join together to form an appropriate barrier as will be appreciated by those of ordinary skill in the art.

The motor 61 and movable partition controller 68 need electric power to operate. This electrical power may be provided by a power supply, which may be placed locally, for example, perhaps at a location within the pocket 20. Alternatively, the power supply may be placed remotely from the movable partition system 10 with power lines running from a battery-backed power supply to the motor 61 and movable partition controller 68. The movable partition controller 68, acting in concert with the power supply and actuation hardware, may be referred to collectively as an automatic closure system 56. In use, the automatic closure system 56 may be configured to extend the movable partition 12 upon the occurrence of a predetermined event, such as the actuation of an associated alarm.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A movable partition system, comprising:

a movable partition;

a track assembly with which the movable partition is engaged and horizontally along which the movable partition is extendable, comprising:

a track for guiding movement of the movable partition along the track assembly; and a shroud at least partially surrounding the track, the shroud and track being sized and shaped to define a gap between the track and the shroud;

an intumescent material interposed between the track and the shroud in the gap between the track and the shroud; and a lead post attached to a distal end of the movable partition, comprising:

a leading distal end;

a cap at least partially surrounding the leading distal end, the cap and the leading distal end being sized and shaped to define a gap between the cap and the leading distal end; and an intumescent material interposed between the leading distal end and the cap within the gap between the cap and the leading distal end.

2. The movable partition system of claim 1, wherein the intumescent material comprises a strip about ½ inch wide and about 1/16 inch thick.

3. The movable partition system of claim 1, further comprising an automatic closure system configured to extend the movable partition upon the occurrence of a predetermined event.

4. The movable partition system of claim 1, wherein the intumescent material comprises a first mass of intumescent material and a second mass of intumescent material spatially separated from the first mass of intumescent material, wherein the first mass of intumescent material and the second mass of intumescent material are shaped and positioned to expand toward one another and contact one another when exposed to fire.

5. The movable partition system of claim 1, wherein the intumescent material comprises a composite material comprising sodium silicate or graphite fibers in a polymer matrix.

6. The movable partition system of claim 1, further comprising:

a jamb attached to a proximal end of the movable partition.

7. The movable partition system of claim 6, wherein the jamb comprises an outside return surface, and an intumescent material is attached to the outside return surface of the jamb.

8. The movable partition system of claim 6, wherein the movable partition is suspended from, and horizontally slidable along, the track assembly.

9. A movable partition system, comprising:

a track assembly, comprising:

at least one track comprising a first bottom surface separated from a second bottom surface by a gap disposed between the first bottom surface and the second bottom surface; and at least one shroud at least partially surrounding the at least one track;

a movable partition engaged with and horizontally extendable along the track assembly;

a first mass of intumescent material disposed between the first bottom surface of the at least one track and the at least one shroud on a first side of the gap; and a second mass of intumescent material disposed between the second bottom surface of the at least one track and the at least one shroud on a second, opposing side of the gap, the first mass of intumescent material and the second mass of intumescent material shaped and positioned to expand toward one another, contact one another, and form a seal therebetween extending along at least a portion of a periphery of the movable partition when the movable partition is exposed to fire, wherein the at least one shroud is configured to confine expansion of at least one of the first mass of intumescent material and the second mass of intumescent material into the gap between the first cup-shaped rail and the second cup-shaped rail.

10. The movable partition system of claim 9, further comprising:

a lead post attached to a distal end of the movable partition; and a jamb attached to a proximal end of the movable partition.

11. The movable partition system of claim 9, wherein the movable partition is suspended from, and horizontally slidable along, the track assembly.

12. The movable partition system of claim 9, further comprising an automatic closure system configured to extend the movable partition upon the occurrence of a predetermined event.

13. The movable partition system of claim 9, wherein the at least one track comprising the at least one track comprises an elongated first cup-shaped rail defining the first bottom surface separated from an elongated second cup-shaped rail defining the second bottom surface by the gap, the first mass of intumescent material disposed adjacent the first cup-shaped rail on the first side of the gap and the second mass of intumescent material disposed adjacent the second cup-shaped rail on the second side of the gap opposite the first side.

14. The movable partition system of claim 13, wherein the first mass of intumescent material comprises an elongated strip of intumescent material extending along the first cup-shaped rail, and the second mass of intumescent material comprises an elongated strip of intumescent material extending along the second cup-shaped rail.

15. A method of providing a fire barrier, comprising:

extending a movable partition along a track assembly with which the movable partition is engaged; and forming a seal extending along at least a portion of the track assembly, at least a portion of a lead post attached to a distal end of the movable partition, and at least a portion of a jamb attached to a proximal end of the movable partition by heating an intumescent material and causing the intumescent material to expand, wherein forming the seal extending along at least a portion of the lead post comprises disposing the intumescent material between a cap at least partially surrounding a leading end of the lead post and the leading end of the lead post.

16. The method of claim 15, further comprising confining expansion of the intumescent material to at least one selected direction.

17. The method of claim 15, wherein heating the intumescent material comprises exposing the intumescent material to fire.

18. The method of claim 15, further comprising automatically sensing the presence of a fire and automatically extending the movable partition along the track assembly in response to the sensing.

19. A method of installing a movable partition system, comprising:

positioning at least one mass of intumescent material to seal at least a section of a gap at a periphery of a movable partition when the at least one mass of intumescent material is exposed to fire;

positioning at least one additional mass of intumescent material to contact the at least one mass of intumescent material at the gap at the periphery of the movable partition when the at least one additional mass of intumescent material is exposed to fire; and confining expansion of the at least one mass of intumescent material toward the at least one additional mass of intumescent material by sandwiching the at least one mass of intumescent material between a shroud and a bottom surface of a track configured to guide extension of the movable partition and confining expansion of the at least one additional mass of intumescent material toward the at least one mass of intumescent material.

20. The method of claim 19, wherein confining expansion of the at least one additional mass of intumescent material toward the at least one mass of intumescent material comprises sandwiching the at least one additional mass of intumescent material between the shroud and another bottom surface of the track.

* * * * *

UNITED STATES PATENT AND TRADEMARK OFFICE

CERTIFICATE OF CORRECTION

PATENT NO. : 8,100,164 B2
APPLICATION NO. : 12/542508
DATED : January 24, 2012
INVENTOR(S) : E. Carl Goodman and Craig Bell It is certified that error appears in the above-identified patent and that said Letters Patent is hereby corrected as shown below:

In the specification:

COLUMN 6, LINE 41, change "FIREFREE®88," to --FIREFREE® 88,--

In the claims:

CLAIM 13, COLUMN 9, LINE 23, delete "comprising the at least one track"

Signed and Sealed this
Eighteenth Day of February, 2014

Michelle K. Lee

Michelle K. Lee
*Deputy Director of the United States Patent and Trademark Office*